US006592404B2

(12) United States Patent
Endo

(10) Patent No.: US 6,592,404 B2
(45) Date of Patent: Jul. 15, 2003

(54) HALF FIT PREVENTIVE CONNECTOR

(75) Inventor: Tomomi Endo, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/863,459

(22) Filed: May 24, 2001

(65) Prior Publication Data

US 2002/0031944 A1 Mar. 14, 2002

(30) Foreign Application Priority Data

Jun. 5, 2000 (JP) ..... 2000-167539

(51) Int. Cl.[7] ..... H01R 13/40
(52) U.S. Cl. ..... 439/595; 439/357
(58) Field of Search ..... 439/357, 358, 439/353, 595

(56) References Cited

U.S. PATENT DOCUMENTS

| | | | | | |
|---|---|---|---|---|---|
| 4,010,998 | A | * | 3/1977 | Tolnar et al. | 439/358 |
| 4,272,145 | A | * | 6/1981 | LaDuke | 439/358 |
| 4,900,263 | A | * | 2/1990 | Manassero et al. | 439/358 |
| 4,979,910 | A | * | 12/1990 | Revil et al. | 439/357 |
| 5,203,719 | A | * | 4/1993 | Kozono | 439/357 |
| 5,391,090 | A | * | 2/1995 | Power | 439/354 |
| 5,938,470 | A | | 8/1999 | Kashiyama | |
| 5,980,297 | A | * | 11/1999 | Sugie | 439/353 |
| 6,179,643 | B1 | * | 1/2001 | Fukuda | 439/353 |
| 6,332,800 | B2 | * | 12/2001 | Kodama | 439/357 |

FOREIGN PATENT DOCUMENTS

| | | | |
|---|---|---|---|
| DE | 199 17 331 A1 | 10/1999 | |
| EP | 0 949 717 A2 | 10/1999 | |
| GB | 2 356 985 A | 6/2001 | ..... H01R/13/629 |
| JP | 11-297423 | 10/1999 | ..... H01R/13/639 |

OTHER PUBLICATIONS

Japanese Abstract 11–297423 Oct. 29, 1999.

* cited by examiner

*Primary Examiner*—Lynn Feild
*Assistant Examiner*—Hae Moon Hyeon
(74) *Attorney, Agent, or Firm*—Sughrue Mion, PLLC

(57) ABSTRACT

In a half fit preventive connector according to the invention, flexible arms are disposed on the upper portion of a housing of a male connector. On the leading end portions of the flexible arms, engaging portions are formed respectively. Further, securing members are disposed on the upper portion of a housing of a female connector. On the inner surfaces of the securing members, arm guide surfaces are formed. Securing step portions are formed in the rear end portions of the securing members. An inclined projection having a flat plate portion and a tapered surface is disposed on a housing main body. When fitting the male and female connectors with each other, while sliding on the arm guide surfaces and the tapered surface of the inclined projection, the flexible arms are flexed inwardly and upwardly, thereby positively preventing the two connectors from being imperfectly fitted with each other.

8 Claims, 9 Drawing Sheets

HALF FIT PREVENTIVE CONNECTOR

BACKGROUND OF THE INVENTION

1. Field of the Invention

The present invention relates to a half fit preventive connector which separates them from each other to thereby recognize that they are fitted with each other imperfectly in case where the two connectors are imperfectly engaged, and secures them to each other unremovably in case where the two connectors are engaged perfectly, when a set of male and female connectors are fitted with each other.

The present application is based on the Japanese Patent Application No. 2000-167539 which is incorporated herein by reference.

2. Description of the Related Art

Conventionally, in a vehicle such as a car, when connecting wires together or connecting together various pieces of electronic equipment, there is often used a connecting method in which they are connected together by fitting a set of male and female connectors with each other. When a set of male and female connectors are fitted with each other, in case where they are half fitted (imperfectly fitted), connecting terminals respectively stored within the two connectors are imperfectly connected with each other, which causes poor contact between them or, what is worse, causes the two connectors to be separated from each other; and, as a result of this, there is a fear that the vehicle fails to run.

To solve the above problems, conventionally, there has been proposed a connector lock mechanism for preventing the connector imperfect fit. Description will be given below of an example of the conventional connector lock mechanism with reference to FIGS. 8 and 9.

In a connector lock mechanism 41 shown in FIG. 8, of a set of male and female connectors 42 and 43, one male connector 42 is extended along the fitting direction (in FIG. 8, the direction of an arrow mark B) where it is fitted with the other female connector 43, and includes a pair of flexible arms 45 and 46 each with an engaging portion 48 formed in the leading end portion thereof. Also, the male connector 42 further includes a terminal storage chamber 42*a*; and, in the terminal storage chamber 42*a*, there are stored two female-type terminals.

The two flexible arms 45 and 46 respectively rise from the rear end side of the upper wall of the housing of the male connector 42 and are extended toward the front end side of the housing upper wall, while the rising base portions of the two flexible arms 45 and 46 join each other to provide a united body. Also, the two flexible arms 45 and 46 are spaced apart from each other in the lateral direction of the connector 42 and are arranged in parallel to each other. The two engaging portions 48 are respectively projections which project outwardly in the lateral direction of the connector 42 from the leading end portions of their associated flexible arms 45 and 46; and, each projection 48 includes a tapered surface which is gradually inclined outwardly from the front end side of the connector housing toward the rear end side thereof.

The female connector 43 comprises a pair of arm guide surfaces 50 and 51 respectively including securing means which not only allow the flexible arms 45 and 46 to flex until the connector mutual fit length reaches a specified length, in other words, until the two connectors are fitted with each other perfectly but also, when the male connector 42 is inserted up to the perfect fit position of the female connector 43, lock the connector fitted state. The female connector 43 stores therein two male-type terminals corresponding to the two female-type terminals of the male connector 42 with which the female connector 43 is to be fitted.

Next, description will be given below of the fitting operation of the male and female connectors 42 and 43.

In the fitting operation starting stage of the male and female connectors 42 and 43, the male connector 42 is fitted into the female connector 43 in such a manner as shown by an arrow mark B. In this case, the two engaging portions 48 formed in the leading end portions of the pair of flexible arms 45 and 46 are respectively inserted into their associated arm guide surfaces 50 and 51 but, in this stage, they are not yet flexed or deformed.

And, in case where the insertion of the male connector 42 is kept on, as shown in FIG. 9, the pair of flexible arms 45 and 46 are flexed and deformed inwardly according to the inclination of the arm guide surfaces 50 and 51. Since the pair of flexible arms 45 and 46 are respectively formed elastic, in these arms 45 and 46, there is generated repulsive force which allows them to return back to their original shapes and thus, due to this repulsive force, the male connector 42 is pushed back in the direction of an arrow mark F shown in FIG. 9.

Therefore, in case where the insertion of the connector 42 is stopped while the two engaging portions 48 formed in the pair of flexible arms 45 and 46 are respectively in contact with the arm guide surfaces 50 and 51, the male connector 42 is removed from the female connector 43, thereby being able to prevent the imperfect fit between the male and female connectors 42 and 43.

And, in case where the male connector 42 is fitted into the female connector 43 perfectly, the two engaging portions 48 respectively get over their associated arm guide surfaces 50, 51 and are then secured to securing means 53, thereby holding the male and female connectors 42 and 43 in a perfectly fitted state where disengagement between the two connectors is impossible. In this state, a connecting terminal embedded in the male connector 42 is contacted with a male-type terminal 55 embedded in the female connector 43, so that the two connectors 42 and 43 are electrically connected with each other.

In the above-mentioned connector lock mechanism, since the repulsive force, that is, the force to separate the male and female connectors 42 and 43 from each other is simply generated by the mutual contact between the pair of flexible arms 45, 46 and the pair of arm guide surfaces 50, 51, the repulsive force is weak.

Therefore, in case where the insertion of the male connector 42 is stopped in a state that the male connector 42 is inserted into the female connector 43 to a certain degree, there is a possibility that the male connector 42 cannot be pushed back and thus an operator can mistake such imperfect fit for perfect fit.

In case where the above-mentioned imperfect fit is left as it is, not only poor electric contact can occur between the two connectors but also the mutual fit between them can be removed during use, thereby raising a fear that the vehicle can fail to run.

Also, in the fitting operation starting stage of the male and female connectors 42 and 43, since the projecting length of the male connector 42 from the female connector 43 can be clearly confirmed through visual observation, there is no possibility that the operator can mistake the imperfect fit for the perfect fit.

On the other hand, in a stage where the fitting operation of the two connectors has advanced, it is difficult for the operator to judge through visual observation whether the connector fitted state is perfect or not. And, in the case of the imperfect fit, the male and female connectors must be positively separated from each other. However, in the above-mentioned conventional connector lock mechanism, actually, for the above-mentioned reason, the male and female connectors are easy to be fitted together imperfectly.

SUMMARY OF THE INVENTION

The present invention aims at eliminating the above drawbacks found in the conventional connector lock mechanism. Accordingly, it is an object of the invention to provide a half fit preventive connector which, when fitting male and female connectors with each other, is positively capable of preventing the male and female connectors from being fitted together imperfectly.

In attaining the above object, according to the invention, there is provided a half fit preventive connector structured such that in one of a set of male and female connectors, there is disposed a flexible arm including an engaging portion in the front end portion thereof and extending in the connector fitting direction and, in the other connector, there are formed an arm guide surface for allowing the flexible arm to flex and deform until the set of male and female connectors are perfectly fitted with each other to thereby urge one connector in the opposite direction to the fitting direction, and a securing step portion for securing the engaging portion when the male and female connectors are perfectly fitted with each other, wherein the other connector includes an inclined projection having a tapered surface for allowing the flexible arm to flex until the attainment of the perfect fit to thereby generate repulsive force for promoting the urge of one connector in the opposite direction to the fitting direction, the inclined projection, in the case of the above-mentioned perfect fit, being capable of removing the promotion of the repulsive force and securing the engaging portion to the securing step portion.

According to the above-structured half fit preventive connector, as the male and female connectors are fitted with each other, a pair of flexible arms are respectively contacted with their associated arm guide surfaces and are thus flexed and deformed inwardly to thereby generate repulsive force for returning the male and female connectors back to their original shapes, while this repulsive force acts on the male and female connectors to separate them from each other. And, in case where the flexible arms are flexed and deformed, the one-end portions of the engaging portions formed in the end portions of the pair of flexible arms, that is, the contact portions of the flexible arms are contacted with the tapered surface of the inclined projection, so that the flexible arms are flexed and deformed in a different direction from a direction where the flexible arms are flexed under the guidance of the arm guide surfaces.

Therefore, since the pair of flexible arms are flexed and deformed in the two different directions respectively due to the arm guide surfaces and the tapered surface of the inclined projection, the repulsive force generated in connection with the tapered surface is added to the repulsive force generated in connection with the arm guide surfaces, which can promote the repulsive force to separate the male and female connectors from each other. Thus, in case where the fitted state of the male and female connectors is imperfect, these two connectors can be positively separated from each other, thereby being positively able to prevent the two connectors from being fitted together imperfectly.

Also, according to another aspect of the invention, in the above-mentioned half fit preventive connector, preferably, each of the engaging portions formed in the end portions of the flexible arms may include a curved-surface-shaped contact portion which, when executing the fitting operation, allows the flexible arm to slide smoothly on the tapered surface.

According to the above-structured half fit preventive connector, since the sliding motion between the engaging portion and tapered surface is performed with a low fitting force, the efficiency of the connector fitting operation can be enhanced.

DETAILED DESCRIPTION OF THE PREFERRED EMBODIMENTS

Figure 1:
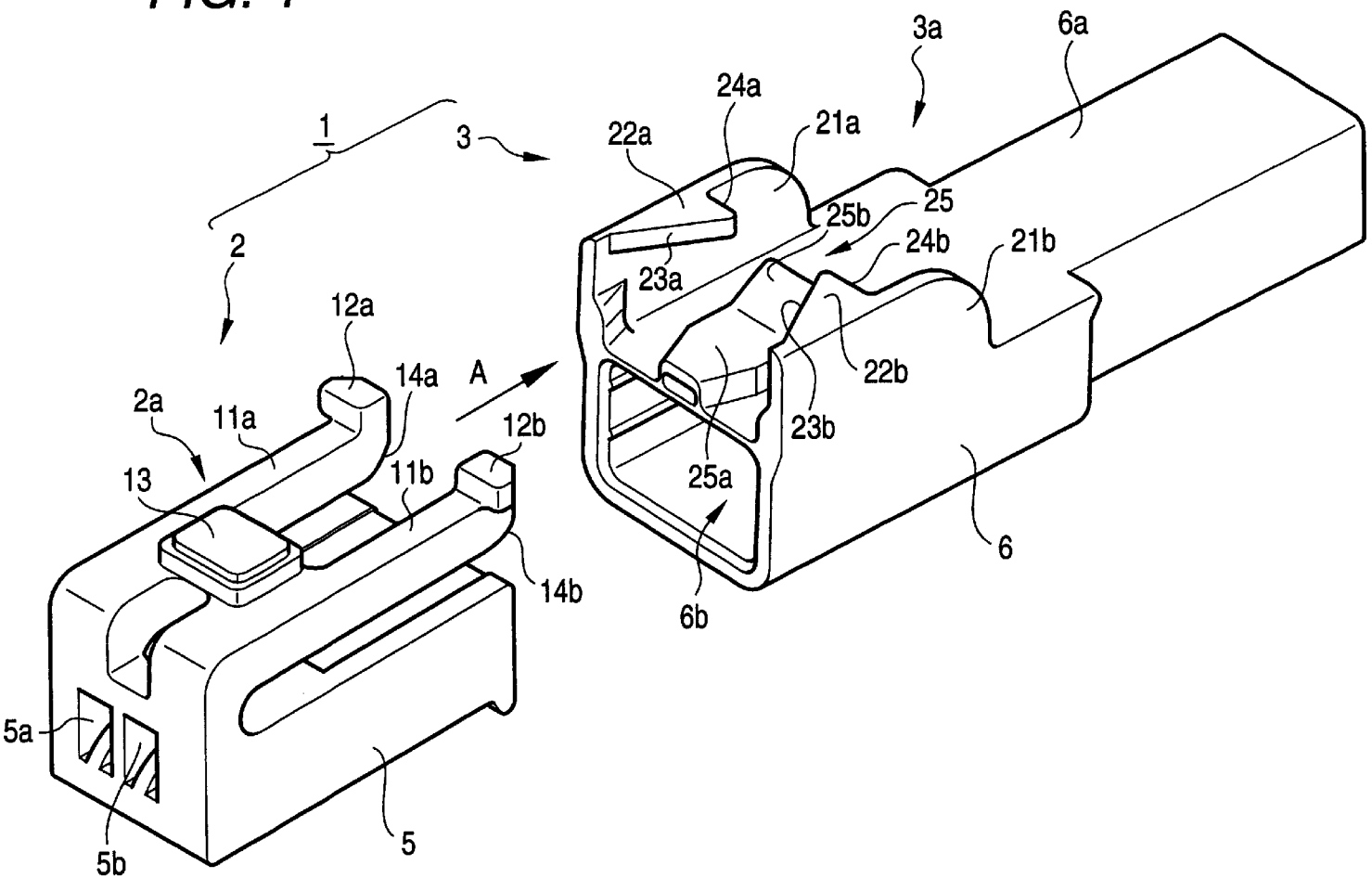
FIG. 1 is an exploded perspective view of an embodiment of a half fit preventive connector according to the invention.
Figure 2:
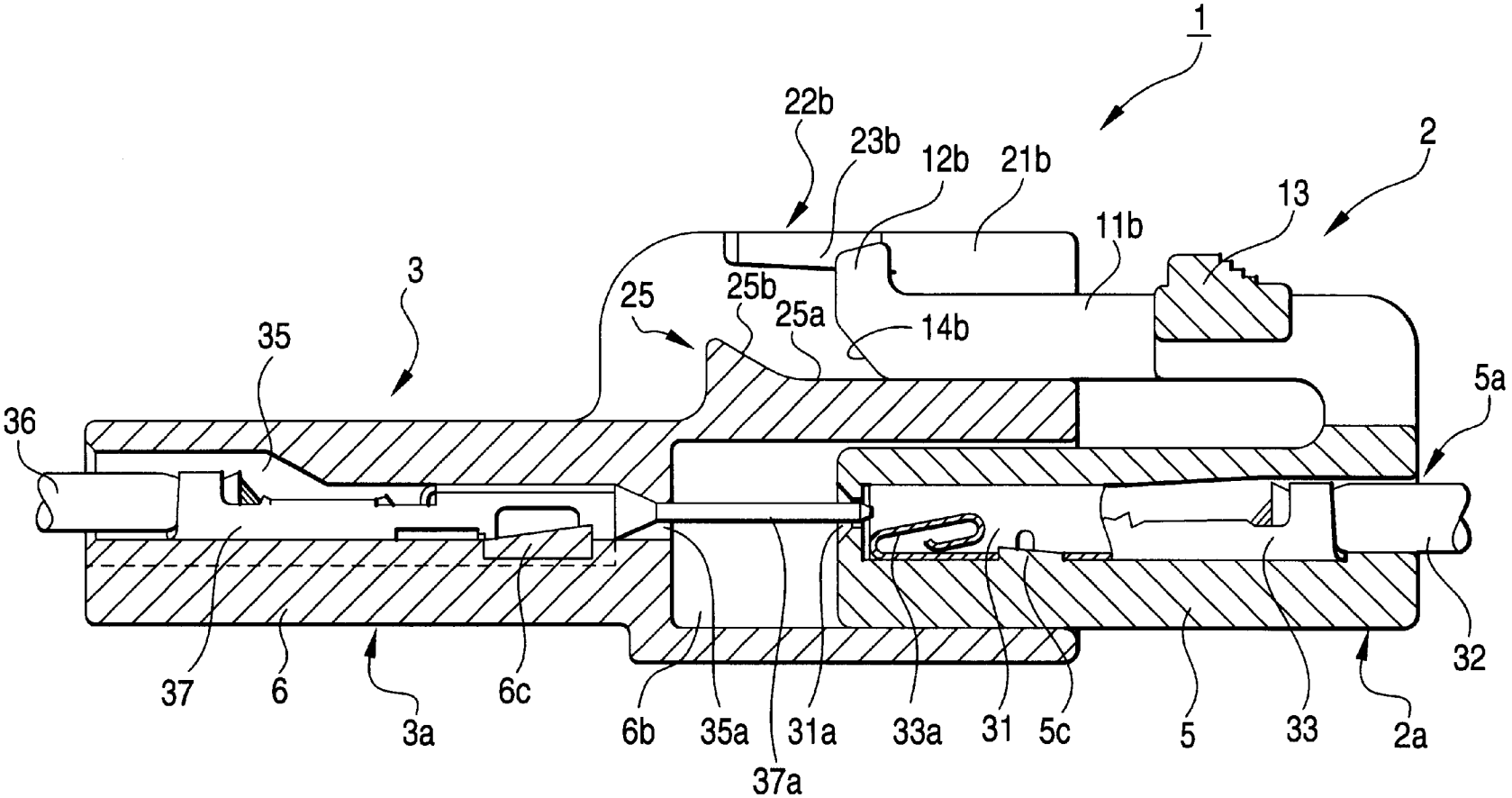
FIG. 2 is a sectional view of the above half fit preventive connector shown in FIG. 1, showing the fitting operation starting state of male and female connectors.
Figure 3:
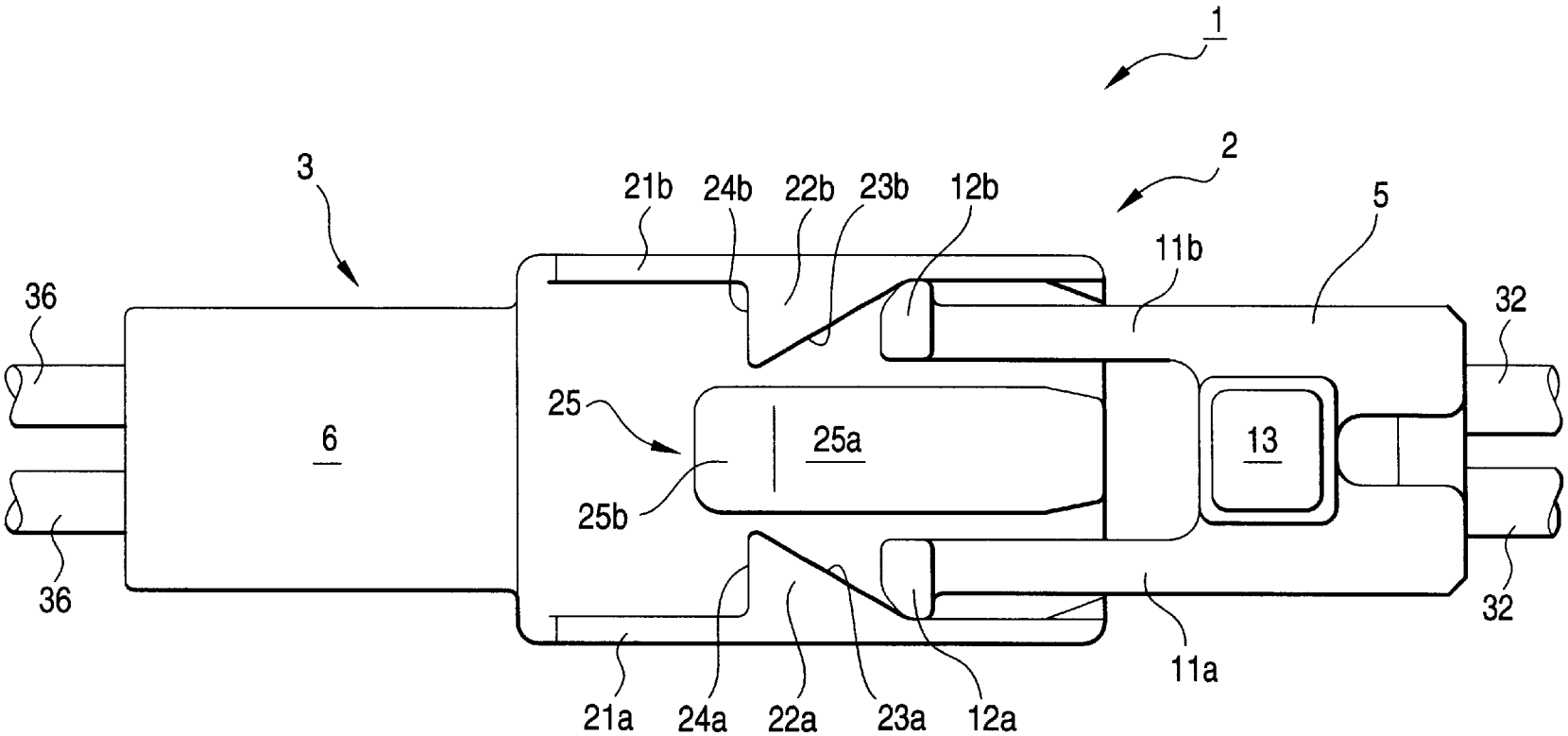
FIG. 3 is a plan view of the male and female connectors shown in FIG. 2.
Figure 4:
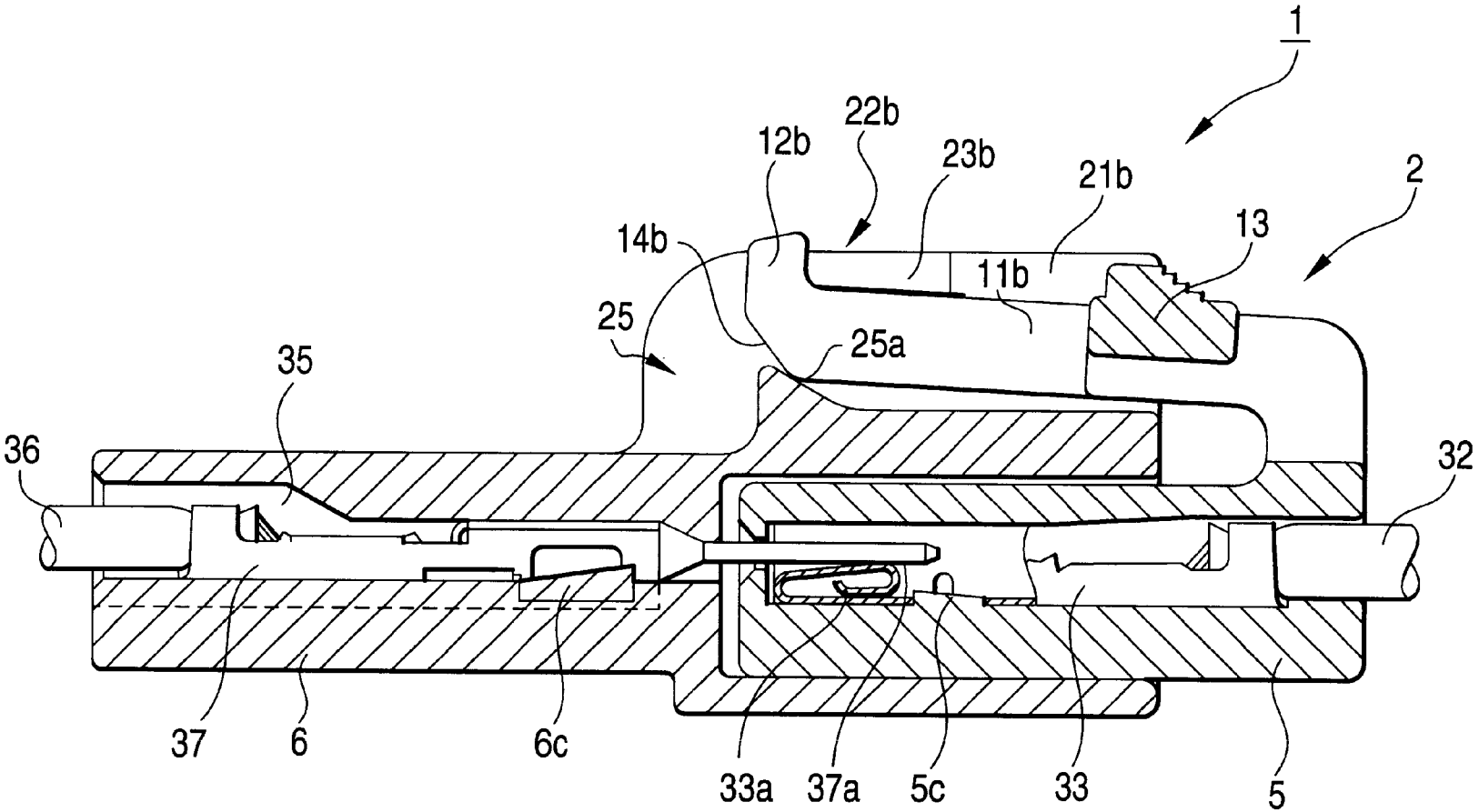
FIG. 4 is a sectional view of the half fit preventive connector shown in FIG. 1, showing the fitting operation intermediate state of the male and female connectors.
Figure 5:
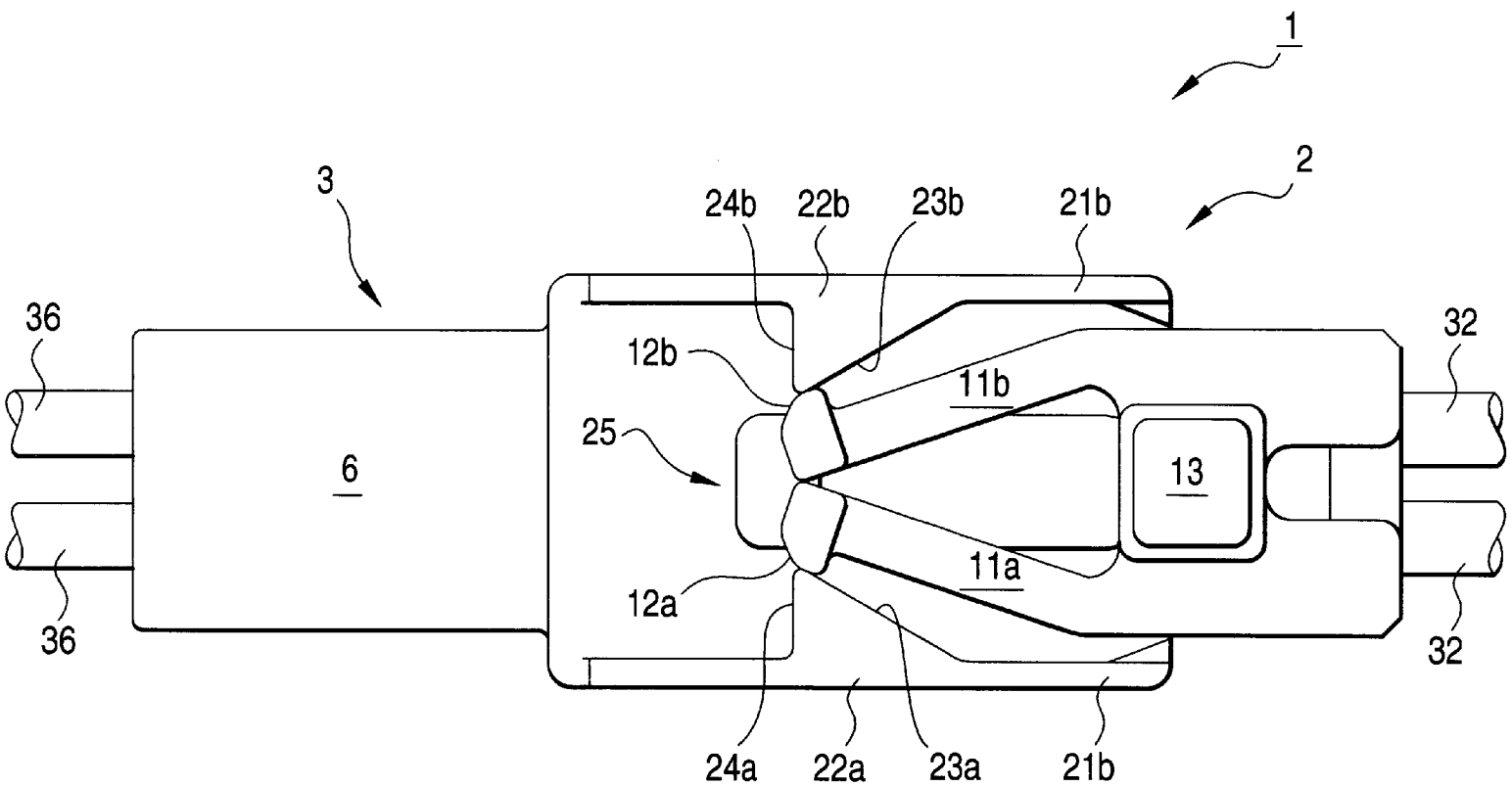
FIG. 5 is a plan view of the male and female connectors shown in FIG. 4.
Figure 6:
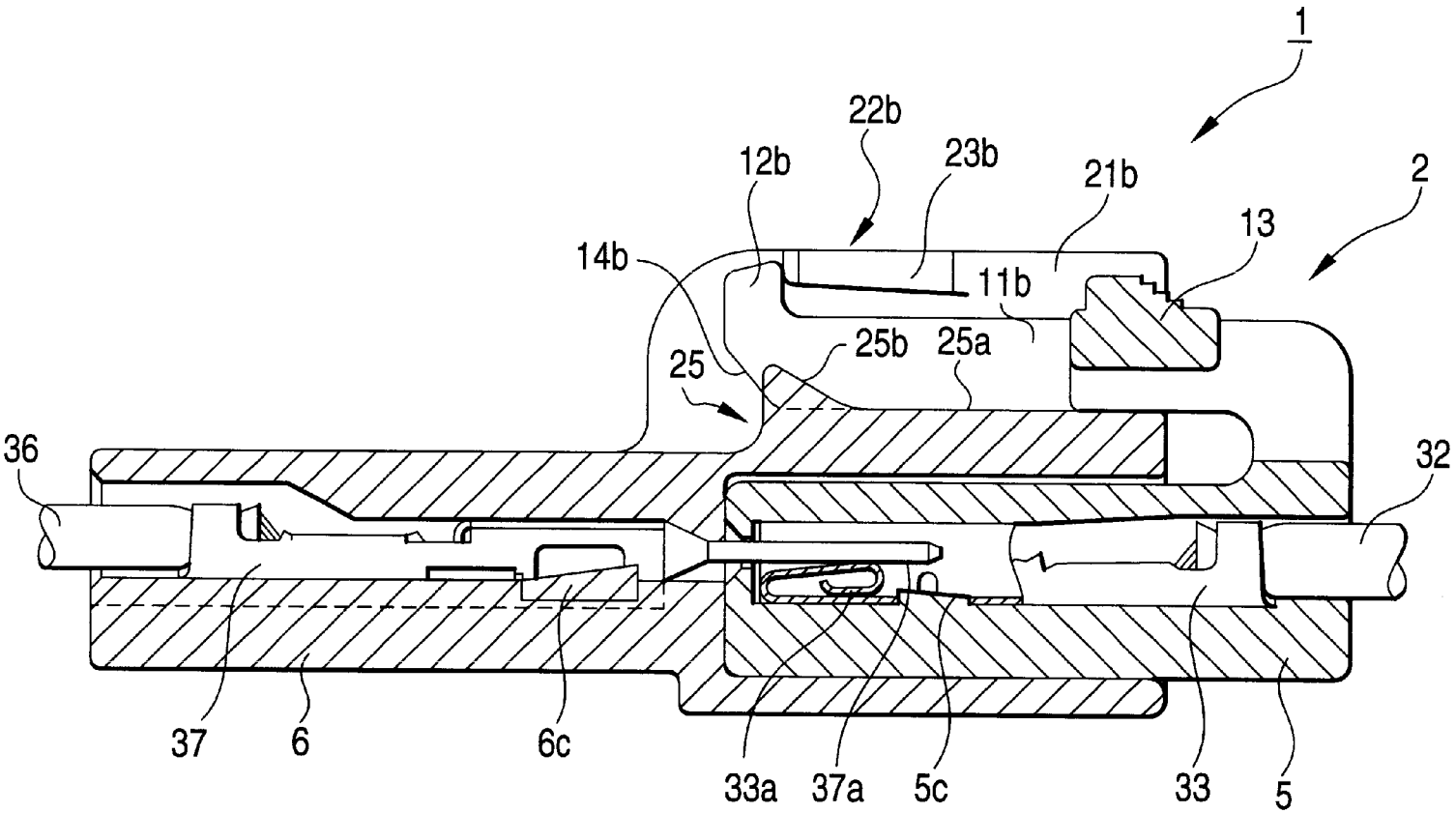
FIG. 6 is a sectional view of the half fit preventive connector shown in FIG. 1, showing the perfectly fitted state of the male and female connectors.
Figure 7:
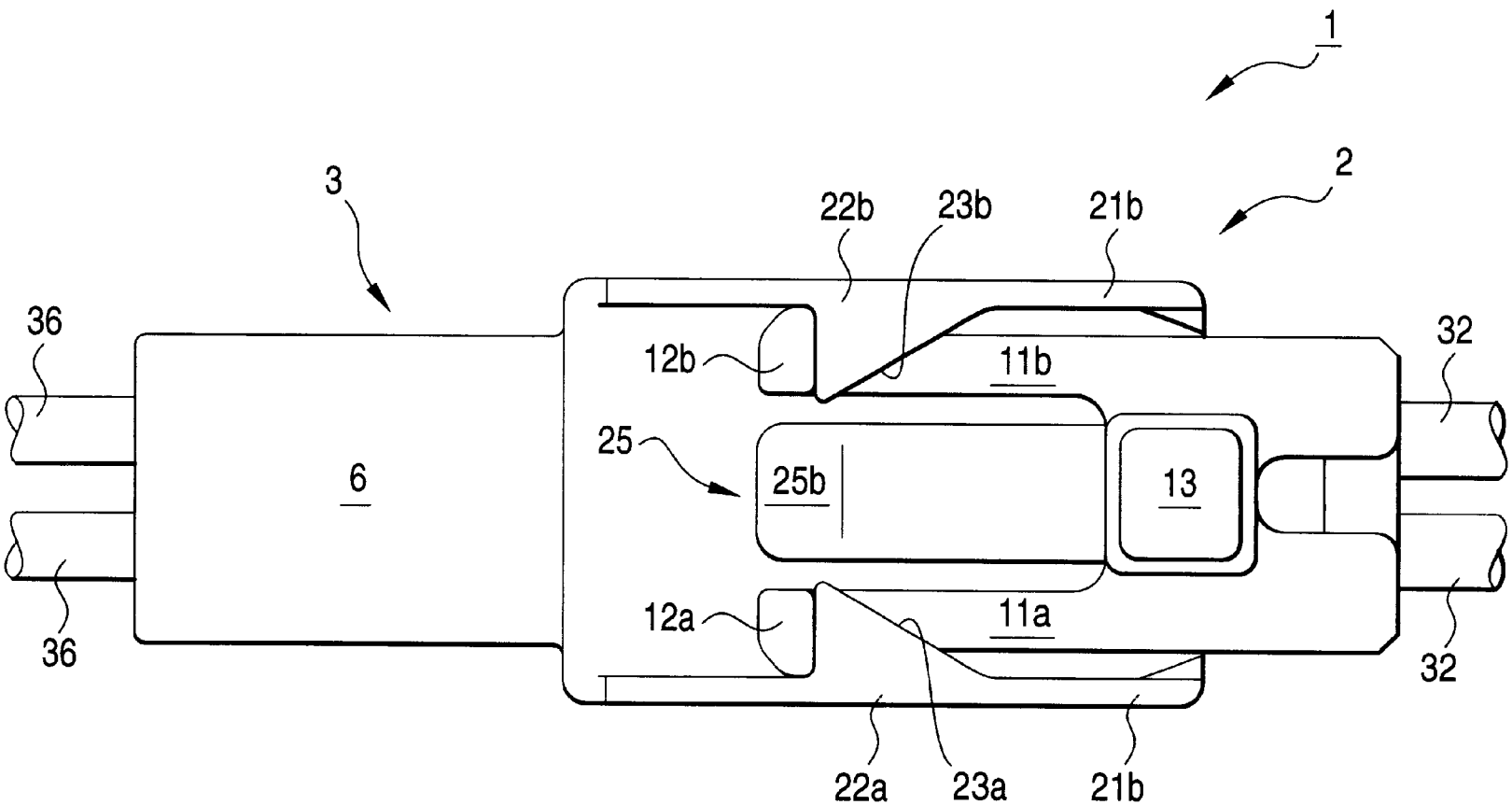
FIG. 7 is a plan view of the male and female connectors shown in FIG. 6.
Figure 8:
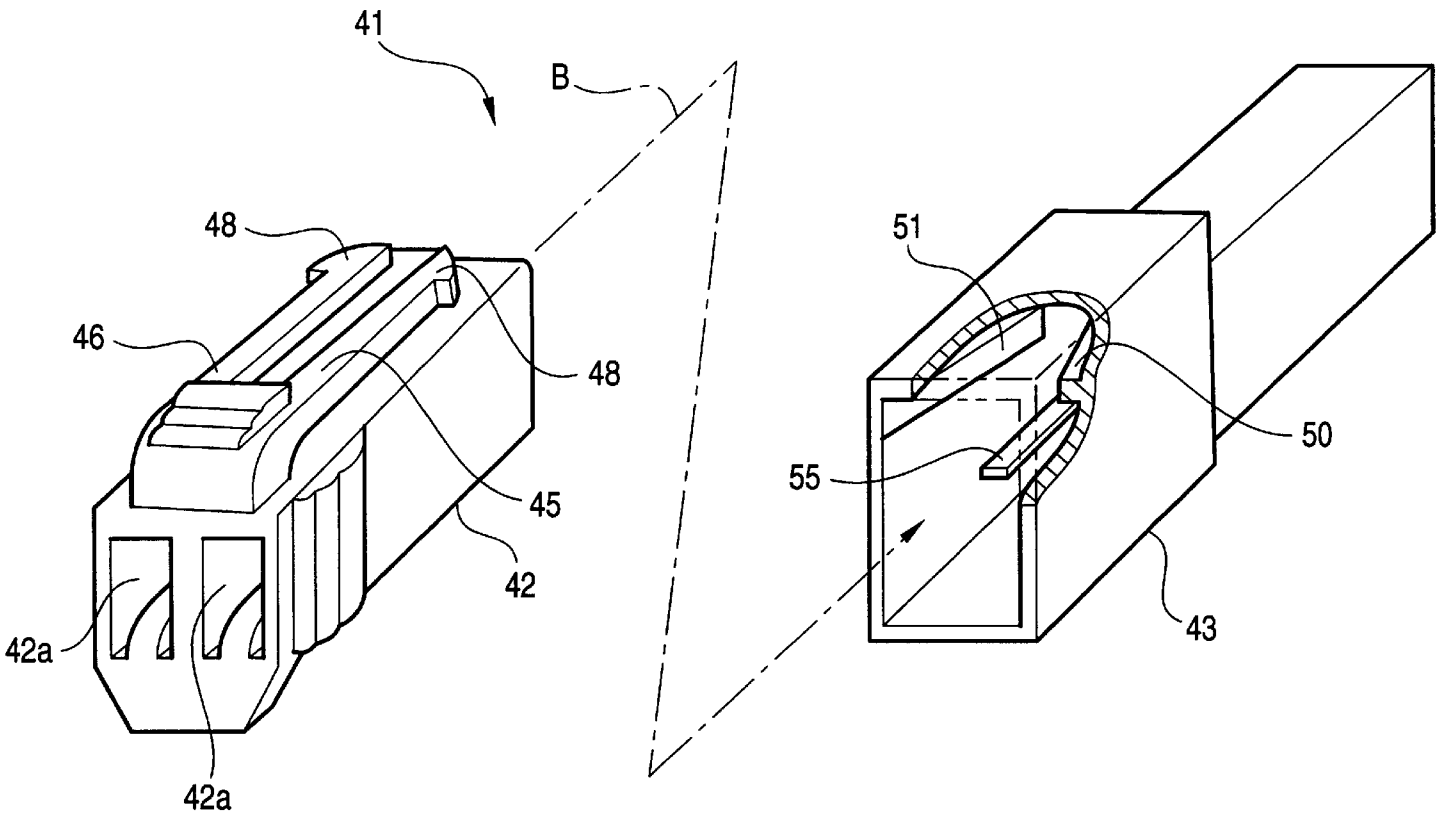
PRIOR ART FIG. 8
FIG. 8 is a sectional view of a conventional lock mechanism.
Figure 9:
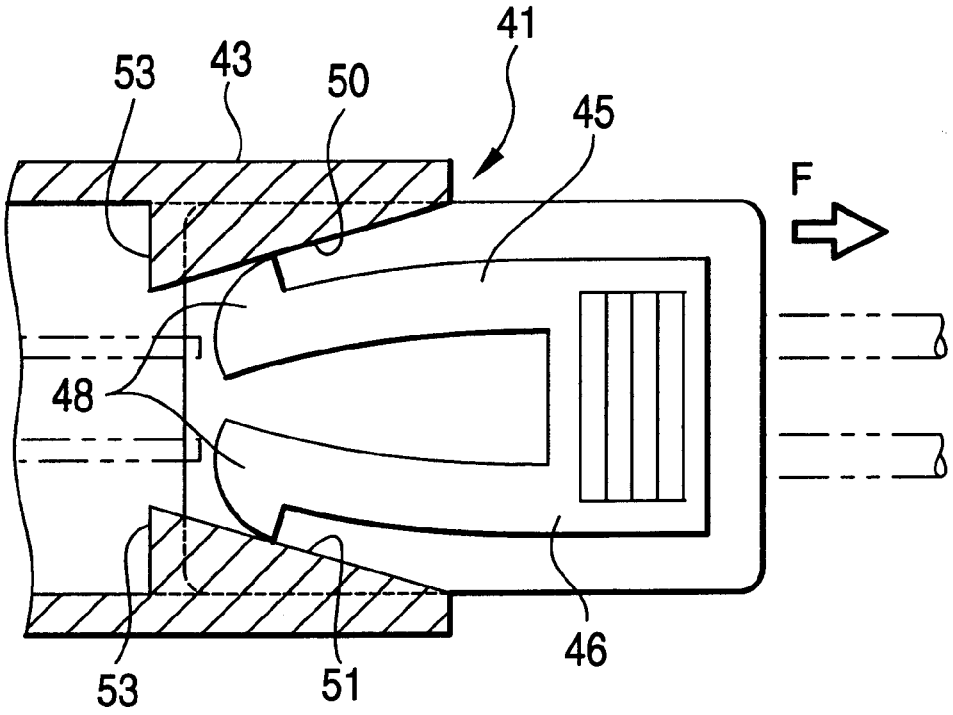
FIG. 9 PRIOR ART
FIG. 9 is a plan view of the conventional lock mechanism shown in FIG. 8, showing the imperfectly fitted state thereof.

Now, description will be given below of an embodiment of a half fit preventive connector according to the invention with reference to FIGS. 1 to 7. Specifically, FIG. 1 is an exploded perspective view of the structure of male and female housings constituting the present half fit preventive connector; FIG. 2 is a sectional view of the male and female housings shown in FIG. 1, showing the fitting operation starting stage thereof; FIG. 3 is a plan view thereof shown in FIG. 2; FIG. 4 is a sectional view of the male and female housings shown in FIG. 1, showing the imperfectly fitted state thereof; FIG. 5 is a plan view thereof shown in FIG. 4; FIG. 6 is a sectional view of the male and female housings shown in FIG. 1, showing the perfectly fitted state thereof; and, FIG. 7 is a plan view thereof shown in FIG. 6.

In a half fit preventive connector 1 according to the present embodiment, after connecting terminals caulked to electric wire end portions to be discussed later are stored into connector housings 2*a* and 3*a* (which are hereinafter referred to as housings simply) shown in FIG. 1, the two housings 2*a* and 3*a* are fitted with each other. That is, as shown in FIG. 2, a male connector 2 with a female-type terminal 33 stored into a terminal storage chamber 31 of the housing 2*a* and a female connector 3 with a male-type terminal 37 stored into a terminal storage chamber 35 of the housing 3*a* are fitted with each other, thereby forming the present half fit preventive connector 1.

As shown in FIG. 1, the housings 2*a* and 3*a* respectively include housing main bodies 5 and 6, the lower portions of which are to be fitted and connected with each other, and further include in the upper portions of the main bodies 5 and 6 a lock mechanism which, due to the mutual actions of the main bodies 5 and 6, not only can prevent the two housings 2*a* and 3*a* from being fitted with each other imperfectly but also, in case where the two housings 2*a* and 3*a* are perfectly fitted together, can keep such perfectly fitted state. As can be seen from the above description, this lock mechanism is divided into two sub-lock mechanisms which are respectively disposed on the housings 2*a* and 3*a*. Now, description will be given below firstly of the lock mechanism that is disposed on the housing 2*a* and, next, the lock mechanism disposed on the housing 3*a* will be discussed.

On the upper portion of the housing 2*a*, there are disposed a pair of flexible arms 11*a* and 11*b* the base portions of which are composed of the rear end portion of the housing 2*a*. The flexible arms 11*a* and 11*b* respectively rise from the rear end portion of the housing 2*a* and are next extended in the fitting direction shown by an arrow mark A in FIG. 1; and, in the leading end portions of the flexible arms 11*a* and 11*b*, there are respectively disposed engaging portions (stepped engaging portions) 12*a* and 12*b* in such a manner that they project outwardly and upwardly.

Also, on the upper surfaces of the two flexible arms 11*a* and 11*b*, there is disposed a pressing part 13 in such a manner that it straddles both of the two flexible arms 11*a* and 11*b*. Since the two flexible arms 11*a* and 11*b* respectively have rod-like shapes, the leading end portions of the two flexible arms 11*a* and 11*b*, which are situated forwardly of the pressing part 13, can be elastically flexed and deformed not only in the lateral direction but also in the vertical direction and, by making use of this elastic flexing and deformation, not only prevention of the imperfect fit but also keeping of the perfect fit can be realized. By the way, in the rear end portion of the housing main body 5, there are formed openings 5*a* and 5*b*; that is, in the connector assembling operation, female-type terminals with electric wires connected thereto can be inserted from these openings 5*a* and 5*b* into the terminal storage chamber 35.

Next, description will be given below of the housing 3*a*. On the two sides of the upper portion of the housing main body 6, there are disposed wall portions 21*a* and 21*b* respectively; and, on the inside portions of the wall portions 21*a* and 21*b*, there are disposed securing members 22*a* and 22*b* in such a manner that they are opposed to each other. These securing members 22*a* and 22*b* respectively include arm guide surfaces 23*a* and 23*b*, which respectively cooperate with their associated flexible arms 11*a* and 11*b* in preventing the imperfect fit, and securing step portions 24*a* and 24*b* which respectively secure their associated engaging portions 12*a* and 12*b* thereto to thereby keep the perfect fit.

On the other hand, on the flat plate portion 6*a* of the housing main body 6, there is disposed an inclined projection 25. This inclined projection 25 includes a flat plate portion 25*a* and a tapered surface 25*b* which are so formed as to extend from the front portion of the inclined projection 25 toward the rear portion thereof in FIG. 1, that is, which are so formed as to extend along the arrow mark A shown in FIG. 1.

The tapered surface 25*b* cooperates with the flexible arms 11*a* and 11*b* in preventing the imperfect fit and also promotes the actions of the arm guide surfaces 23*a* and 23*b*. By the way, when the two connectors are fitted together, the lower portions of the leading ends of the flexible arms 11*a* and 11*b* slide on the tapered surface 25*b*. Therefore, the leading end lower portions of the flexible arms 11*a* and 11*b*, that is, the contact portions 14*a* and 14*b* thereof, which are the lower portions of the engaging portions 12*a* and 12*b*, are formed as curved surfaces for smooth sliding motion of the flexible arms 11*a* and 11*b*.

Also, in the rear end portion of the housing main body 6, there is formed a fit hole 6*b* which is used to allow the housing main body 5 to be fitted with the housing main body 6 and, in the rear of the fit hole 6*b*, there is formed a terminal storage chamber 35 (see FIG. 2) in such a manner that it communicates with the fit hole 6*b*.

Next, description will be given below of the operation to be executed when the male and female connectors 2 and 3 are fitted with each other.

As shown in FIG. 2, the female-type terminal 33 with the end portion of an electric wire 32 caulked and connected thereto is inserted from the opening 5*a* into the terminal storage chamber 31 formed in the housing main body 5, whereby the male connector 2 can be unremovably secured to the female connector 3.

Also, on the lower end portion of the terminal storage chamber 31, there is disposed a securing projection 5*c* which secures the female-type terminal 33 thereto unremovably and, in the front interior portion of the female-type terminal 33, there is formed a plate-spring-shaped contact portion 33*a* which can be elastically contacted with its mating terminal. Also, in the leading end portion of the terminal storage chamber 31, there is formed an insertion hole 31*a* through which the mating terminal can be inserted.

On the other hand, as shown in FIG. 2, a male-type terminal 37 with the end portion of an electric wire 36 caulked and connected thereto is inserted into the terminal storage chamber 35 formed within the housing main body 6, whereby the female connector 3 can be unremovably secured to the male connector 2.

Also, on the lower end portion of the terminal storage chamber 35, there is disposed a securing projection 6*c* which secures the male-type terminal 37 thereto unremovably and, in the leading end portion of the male-type terminal 37, there is formed a rod-shaped connecting portion 37*a* which can be contacted with the contact portion 33*a*. Further, in the leading end portion of the terminal storage chamber 35, there is formed an insertion hole 35*a* through which the connecting portion 37*a* can be inserted.

Next, description will be given below of the operation to be executed when the male and female connectors 2 and 3 are fitted with each other.

To fit the male and female connectors 2 and 3 with each other, as shown by the arrow mark A in FIG. 1, the housing main body 5 of the housing 2*a* is opposed to and pushed into the fit hole 6*b* formed in the housing 3*a*. As a result of this, the pair of flexible arms 11*a* and 11*b* are respectively inserted into the wall portions 21*a* and 21*b* formed in the upper portion of the housing main body 6; and, in case where the pushing of the housing main body 5 is kept on, as shown in FIGS. 2 and 3, the engaging portions 12*a* and 12*b* are respectively contacted with their associated arm guide surfaces 23*a* and 23*b*.

That is, as shown in FIG. 2, the housing main body 5 of the male connector 2 is pushed into the fit hole 6*b* of the female connector 3, so that the connecting portion 37*a* projected from the fit hole 6*b* is going to be inserted into the insertion hole 31*a* formed on the male connector 2 side.

According to the present embodiment, as shown in FIG. 3, since the length required for the engaging portions 12*a* and 12*b* to be contacted with the arm guide surfaces 23*a* and 23*b* is relatively long, in the fitting operation starting stage, the fitting operation between the two connectors 2 and 3 can be carried out substantially with no resistance. For this reason, due to the contact of the engaging portions 12*a* and 12*b* with the arm guide surfaces 23*a* and 23*b*, the sense of resistance is increased, which allows the operator to recognize the fitting state between the two connectors 2 and 3.

And, referring to the state of the lock structure in the fitting operation starting stage, as shown in FIG. 3, the engaging portions 12*a* and 12*b* formed in the leading end portions of the pair of flexible arms 11*a* and 11*b* are in contact with the base portions of the arm guide surfaces 23*a* and 23*b* under the guidance of the wall portions 21*a* and 21*b*. However, the pair of flexible arms 11*a* and 11*b* are respectively formed in a straight shape and thus there is generated no repulsive force that separates the male and female connectors 2 and 3 from each other.

Also, as shown in FIG. 2, the contact portion 14*b* is not yet contacted with the tapered surface 25*b* of the inclined projection 25 and thus, in the inclined projection 25 as well, there is generated no repulsive force. Therefore, at the then time, there is not yet enforced a preventive action for prevention of the imperfect fit between the two connectors but, since the amount of fit between them is small, there is no possibility that the imperfect fit can be mistaken for the perfect fit.

Further, in case where the mutual insertion of the male and female connectors 2 and 3 is further kept on, as shown in FIGS. 4 and 5, the engaging portions 12*a* and 12*b* formed in the leading end portions of the pair of flexible arms 11*a* and 11*b* are contacted with the arm guide surfaces 23*a* and 23*b*, so that the pair of flexible arms 11*a* and 11*b* are flexed and deformed inwardly along the inclination of the arm guide surfaces 23*a* and 23*b*.

And, due to the inward flexing and deformation of the pair of flexible arms 11*a* and 11*b*, the contact portions 14*a* and 14*b* of the engaging portions 12*a* and 12*b* are in part contacted with the tapered surface 25*b* of the inclined projection 25. Therefore, the pair of flexible arms 11*a* and 11*b* are flexed and deformed not only inwardly but also upwardly, thereby generating repulsive force which separates the male and female connectors 2 and 3 from each other.

Further, in case where the fitting operation of the male and female connectors 2 and 3 is advanced still further, the pair of flexible arms 11*a* and 11*b* approach the neighboring portions of the top portions of not only the arm guide surfaces 23*a* and 23*b* but also the tapered surface 25*b* of the inclined projection 25, so that the inward and upward flexing and deformation of the pair of flexible arms 11*a* and 11*b* becomes the largest. Therefore, when fitting the male and female connectors 2 and 3 with each other, from the fitting operation starting time to the time when the pair of flexible arms 11*a* and 11*b* approach the arm guide surfaces 23*a* and 23*b*, no repulsive force is generated; however, after the time when the pair of flexible arms 11*a* and 11*b* approach the arm guide surfaces 23*a* and 23*b* to the time when they approach the top portions of the arm guide surfaces 23*a* and 23*b*, there is generated repulsive force.

What is of note here is that, because the pair of flexible arms 11*a* and 11*b* are flexed and deformed inwardly, there is generated repulsive force and, at the same time, because the pair of flexible arms 11*a* and 11*b* climb onto the tapered surface 25*b* of the inclined projection 25, there is generated another repulsive force that is added to the above repulsive force. And, the two kinds of repulsive force increases as the fitting operation between the male and female connectors 2 and 3 advances.

Therefore, since the repulsive force to separate the male and female connectors 2 and 3 is promoted, assuming that the operator mistakes the imperfect fit for the perfect fit and thus stops the fitting operation, the male and female connectors 2 and 3 being fitted can be positively separated from each other, thereby being able to prevent the male and female connectors 2 and 3 from being imperfectly fitted with each other.

And, in case where the fitting operation between the male and female connectors 2 and 3 is advanced further, as shown in FIGS. 6 and 7, the pair of flexible arms 11*a* and 11*b* climb beyond the arm guide surfaces 23*a* and 23*b* and are then secured to the securing members 22*a* and 22*b*, so that they are allowed to return back to their original straight shapes.

Therefore, the engaging portions 12*a* and 12*b* are separated outwardly from the upper portion of the inclined projection 25, and the contact between the tapered surface 25*b* of the inclined projection 25 and the contact portions 14*a* and 14*b* is removed, with the result that there is not generated any longer the repulsive force which separates the male and female connectors 2 and 3 from each other. Accordingly, the housing main body of the male connector 2 is perfectly fitted into the fit hole 6*b* of the female connector 3 and thus the connecting portion 37*a* is contacted with the contact portion 33*a*, thereby allowing the male and female connectors 2 and 3 to be electrically connected with each other.

By the way, to remove the fitted state between the male and female connectors 2 and 3, the pressing part 13 may be pushed with a finger to thereby press down the pair of flexible arms 11*a* and 11*b*, and the engaging portions 12*a* and 12*b* may be removed from the securing members 22*a* and 22*b* to thereby pull them out: that is, the fitted state between the male and female connectors 2 and 3 can be removed very simply.

As has been described heretofore, in a half fit preventive connector according to the invention, in the other connector, there is disposed an inclined projection which has a tapered surface for allowing the flexible arms to flex until the two connectors are perfectly fitted together to thereby generate the repulsive force to promote the urge of one connector in the opposite direction to the fitting direction and also which, when the two connectors are perfectly fitted with each other, is capable of removing the promotion of the repulsive force and securing the engaging portions to the securing step portions.

Therefore, as the male and female connectors are fitted with each other, the pair of flexible arms are flexed and deformed in two different directions due to the arm guide surfaces and the tapered surface of the inclined projection, and the repulsive force generated in connection with the tapered surface is added to the repulsive force generated in connection with the arm guide surfaces, thereby promoting the repulsive force which separates the male and female connectors from each other. Thus, in case where the fitted state between the male and female connectors is imperfect, the two connectors are positively separated from each other, thereby being able to positively prevent the two connectors from being imperfectly fitted with each other.

Also, in the present half fit preventive connector, the engaging portion formed in the end portion of the flexible arm includes a curved-surface-shaped contact portion which, when fitting the male and female connectors with each other, is used for smooth sliding motion of the flexible arm on the tapered surface. Therefore, since the sliding motion of the engaging portion with respect to the tapered surface is executed with a low fitting force, the efficiency of the connector fitting operation can be enhanced.

What is claimed is:

1. A half fit preventive connector comprising:

a flexible arm formed on a first connector, extending in the connector fitting direction, and provided with a stepped engaging portion in a front end portion thereof, said stepped engaging portion extends outwardly in a direction away from the connector fitting direction;

a securing member formed on a second connector, provided with an arm guide surface for allowing said flexible arm to flex and a securing step portion for securing said stepped engaging portion of said flexible arm thereinto by engagement of said stepped engaging portion with said securing step portion; and a projection formed on said second connector, provided with a flat portion and a tapered surface for allowing said flexible arm to flex;

wherein a first repulsion force is generated between said flexible arm and said arm guide surface by sliding said flexible arm on said arm guide surface and a second repulsion force is generated between said flexible arm and said projection by sliding flexible arm on said projection according to the connector fitting operation, so that said first and second connectors are urged in the opposite direction to the connector fitting direction until said first and second connectors are perfectly fitted with each other.

2. A half fit preventive connector according to claim 1, wherein said engaging portion of said flexible arm is provided with a curved-surface-shaped contact portion to thereby allow said flexible arm to slide smoothly on said tapered surface of said projection.

3. A half fit preventive connector according to claim 1 wherein said flexible arm is provided as a pair of flexible arms and said securing member is provided as a pair of securing members.

4. A half fit preventive connector according to claim 3, wherein said flexible arms are flexed inwardly by said guide surfaces of said securing members so as to be narrowed a distance between said flexible arms, and said flexible arms are flexed upwardly by said taped surface of said projection according to the connector fitting operation.

5. A half fit preventive connector comprising:

a first connector;

a pair of flexible arms formed on an upper portion of said first connector;

a stepped engaging portion formed on a leading end portion of each flexible arm, said stepped engaging portion extends outwardly in a direction away from a connector fitting direction;

a second connector;

a pair of securing members formed on an upper portion of said second connector and provided with a securing step portion formed in a rear end portion thereof;

a first flexing means for flexing said flexible arms inwardly so as to be narrowed a distance between said flexible arms according to the connector fitting operation; and a second flexing means for flexing said flexible arms upwardly according to the connector fitting operation;

wherein repulsion force for urging said first and second connectors in the opposite direction to the connector fitting direction is generated by flexing said flexible arms until said first and second connectors are perfectly fitted with each other whereupon said stepped engaging portion of each of flexible arms is engaged with said step securing portion.

6. A half fit preventive connector according to claim 5, wherein said first flexing means comprises an guide surface formed on an inner surface of said securing member.

7. A half fit preventive connector according to claim 5, wherein said second flexing means comprises a projection formed on an upper portion of said second connector, provided with a flat plate portion and a tapered surface for allowing said flexible arm to be flexed.

8. A half fit preventive connector according to claim 7, wherein each engaging portion of said flexible arms is provided with a curved-surface-shaped contact portion to thereby allow said flexible arm to slide smoothly on said tapered surface of said projection.

* * * * *